US007134912B2

(12) United States Patent
Kamata et al.

(10) Patent No.: US 7,134,912 B2
(45) Date of Patent: Nov. 14, 2006

(54) ELECTRICAL CONNECTOR HAVING A SHELL WITH A PORTION WHICH IS ELASTICALLY MOVABLE IN A FITTING PORTION OF THE CONNECTOR

(75) Inventors: Kazushi Kamata, Aomori (JP); Koji Hayashi, Tokyo (JP); Nobukazu Kato, Tokyo (JP)

(73) Assignees: Japan Aviation Electronics Industry, Limited, Tokyo (JP); JAE Hirosaki, Ltd., Hirosaki (JP)

( * ) Notice: Subject to any disclaimer, the term of this patent is extended or adjusted under 35 U.S.C. 154(b) by 0 days.

(21) Appl. No.: 11/134,201

(22) Filed: May 20, 2005

(65) Prior Publication Data

US 2005/0260871 A1 Nov. 24, 2005

(30) Foreign Application Priority Data

May 21, 2004 (JP) ..... 2004-151709

(51) Int. Cl.
*H01R 13/648* (2006.01)

(52) U.S. Cl. ..... 439/609; 439/607

(58) Field of Classification Search ..... 439/609, 439/607, 95

See application file for complete search history.

(56) References Cited

U.S. PATENT DOCUMENTS 4,623,211 A * 11/1986 Dambach et al. ..... 439/607
4,718,867 A * 1/1988 Seidel et al. ..... 439/609
5,288,247 A * 2/1994 Kaufman ..... 439/607
5,478,260 A * 12/1995 Kaufman et al. ..... 439/609
5,807,137 A * 9/1998 Janota et al. ..... 439/607
5,921,814 A * 7/1999 Maruyama ..... 439/607
6,056,600 A * 5/2000 Watanabe et al. ..... 439/607
6,066,000 A * 5/2000 Masumoto et al. ..... 439/607
6,074,223 A * 6/2000 Huang ..... 439/95
6,241,556 B1 * 6/2001 Chih ..... 439/607
6,682,368 B1 * 1/2004 Murr et al. ..... 439/607
6,755,689 B1 * 6/2004 Zhang et al. ..... 439/607
6,840,806 B1 * 1/2005 Kodama ..... 439/607

FOREIGN PATENT DOCUMENTS

JP 2003007408 1/2003

* cited by examiner

*Primary Examiner*—Gary F. Paumen
(74) *Attorney, Agent, or Firm*—Collard & Roe, P.C.

(57) ABSTRACT

In an electrical connector, a shell includes a body portion and a folded portion extending from the body portion and folded inward of the body portion. The body portion surrounds an outer peripheral surface of an insulator having a fitting portion for receiving a mating member and holding a contact adapted to be electrically connected to the mating member. The folded portion includes a contact point portion to be contacted with the mating member in the fitting portion and a spring portion coupled to the contact point portion to make the contact point portion be elastically movable.

11 Claims, 4 Drawing Sheets

ELECTRICAL CONNECTOR HAVING A SHELL WITH A PORTION WHICH IS ELASTICALLY MOVABLE IN A FITTING PORTION OF THE CONNECTOR

This application claims priority to prior Japanese patent application JP 2004-151709, the disclosure of which is incorporated herein by reference.

BACKGROUND OF THE INVENTION

This invention relates to an electrical connector and, in particular, to an electrical connector in which an insulator holding a contact is provided with a shell attached thereto.

For example, an electrical connector of the type is disclosed in Japanese Unexamined Patent Application Publication (JP-A) No. 2003-7408. The electrical connector comprises a plurality of conductive terminals arranged in a predetermined direction, an insulator holding the terminals, a shell attached to an outer surface of the insulator, and a plate-like conductive ground portion extending in the predetermined direction. The ground portion and the shell are formed into an integral structure. Therefore, the number of parts is reduced and the operation of attaching these parts to the insulator is not troublesome. Upon connection, a mating member is inserted between each terminal and the ground portion. In order to establish contact between the mating member and the ground portion, the ground portion is provided with a protrusion protruding towards a region into which the mating member is inserted. Therefore, the mating member can be electrically connected not only to each terminal but also to the shell via the ground portion.

However, since the ground portion has no elasticity, sufficient contact may not be achieved between the protrusion of the ground portion and the mating member. If contact between the protrusion and the mating member is insufficient, the shell is not electrically connected to the mating member so that predetermined electric characteristics can not be obtained. In view of the above, use may be made of a structure in which the mating member is strongly contacted with the protrusion of the ground portion. In this case, the mating member is strongly contacted with each terminal also. Accordingly, a contacting portion of each terminal may be damaged.

SUMMARY OF THE INVENTION

It is therefore an object of this invention to provide an electrical connector having a ground portion integrally formed with a shell and making good contact with a mating member.

It is another object of this invention to provide an electrical connector capable of preventing a contacting portion of each terminal from being damaged.

Other objects of the present invention will become clear as the description proceeds.

According to the present invention, there is provided an electrical connector comprising an insulator having a fitting portion for receiving a mating member, a contact held by the insulator and adapted to be electrically connected to the mating member, and a shell coupled to the insulator, the shell including a body portion surrounding an outer peripheral surface of the insulator and a first folded portion extending from the body portion and folded inward of the body portion, the first folded portion including a contact point portion to be contacted with the mating member in the fitting portion and a spring portion coupled to the contact point portion to make the contact point portion be elastically movable.

DESCRIPTION OF THE PREFERRED EMBODIMENT

Figure 1:
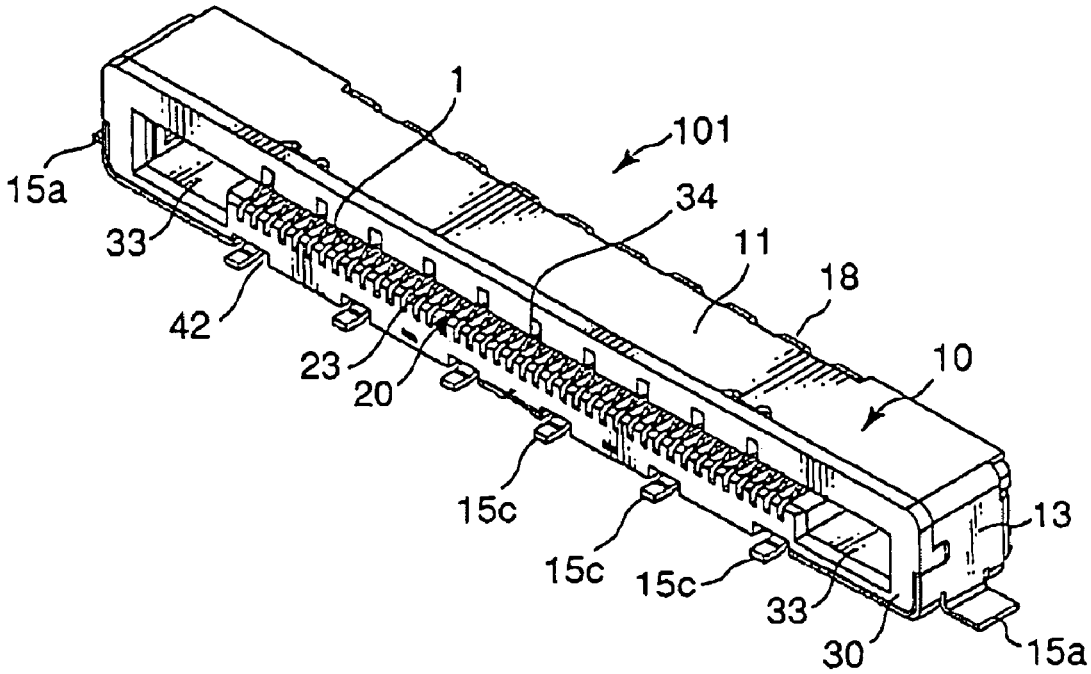
FIG. 1 is a perspective view of a socket connector according to an embodiment of this invention.

Now, description will be made of an embodiment of this invention with reference to the drawing.

Referring to FIGS. 1 through 4, an electrical connector 101 is used as a board-mount socket connector mounted to a board or the like of an apparatus body. The electrical connector 101 comprises a plurality of socket contacts 20 having contacting portions 23, respectively, a socket insulator 30 holding the socket contacts 20, and a socket shell 10 surrounding the socket insulator 30. Each of the socket contacts 20 is made of a conductive material and serves to transmit electric signals in the manner known in the art. The socket shell 10 is made of a conductive material.

As will later be described in detail in conjunction with FIGS. 5 and 6, the socket insulator 30 has a fitting portion 1 with a connecting hole to be fitted to a mating member or a mating connector such as a plug connector 102. The contacting portions 23 of the socket contacts 20 are arranged in the connecting hole of the fitting portion 1. The fitting portion 1 is provided with a pair of guide holes 33 formed on opposite sides of the connecting holes to guide a pair of guide posts 68 of the plug connector 102, respectively. Each of the guide holes 33 is opened wider than the connecting hole of the fitting portion 1 in a height direction. Therefore, the guide posts 68 of the plug connector 102 are prevented from being erroneously inserted into the fitting portion 1 to damage or bend the socket contacts 20. It is to be noted that each of the guide holes 33 is provided with a guide groove 37 formed on an outer wall thereof.

The socket insulator 30 is provided with a plurality of ground grooves 34 formed in an upper portion 30*a* of the fitting portion 1. The ground grooves 34 are arranged in a first or longitudinal direction. Each of the ground grooves 34 extends in parallel to one another in a second or width direction. The socket insulator 30 is provided with a plurality of contact grooves 35 formed on a lower portion 30*b* of the fitting portion 1. The socket contacts 20 are received in the contact grooves 35, respectively. The lower portion 30*b* of the socket insulator 30 is provided with several press-fit holes 36 opened on a rear side of the socket insulator 30. The upper portion 30*a* of the socket insulator 30 may be provided with several press-fit holes opened on a rear side of the socket insulator.

Figure 2:
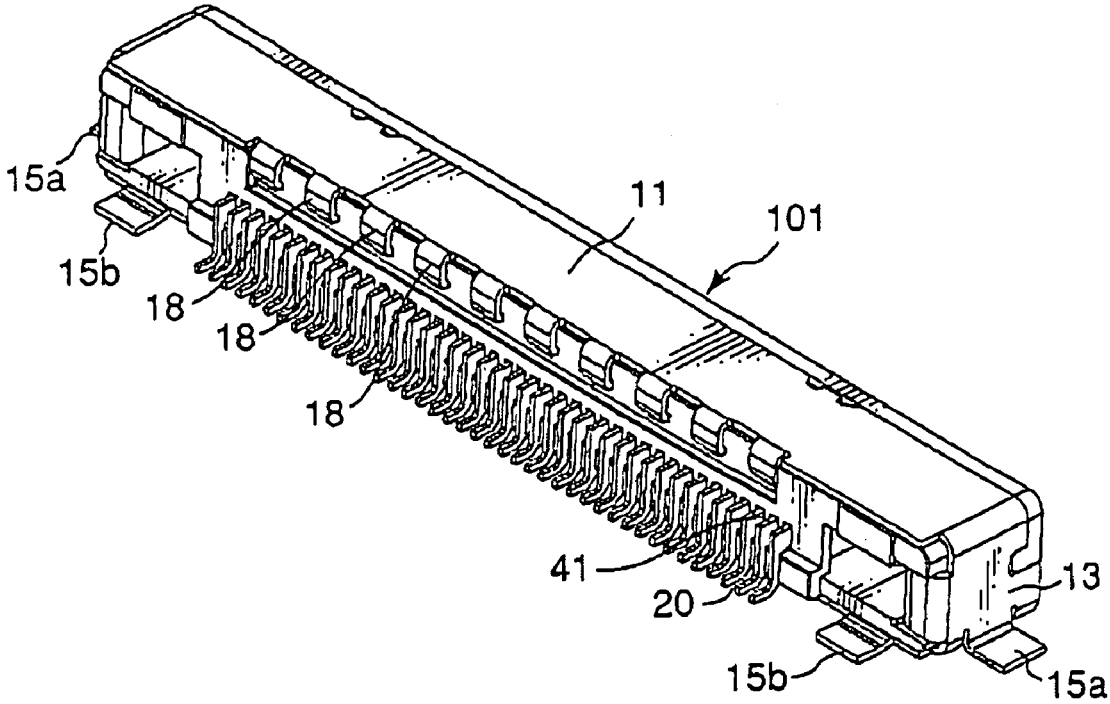
FIG. 2 is a rear perspective view of the socket connector in FIG. 1.
Figure 3:
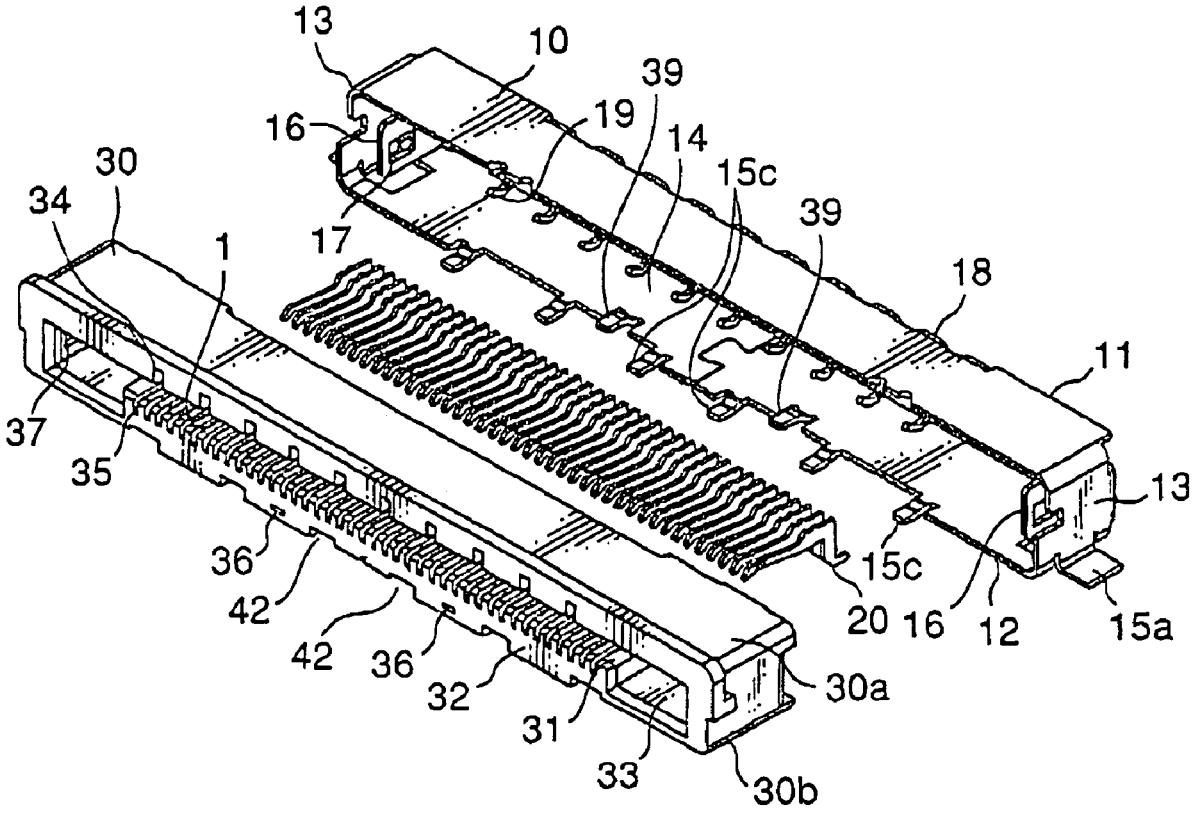
FIG. 3 is an exploded perspective view of the socket connector in FIG. 1.

As shown in FIG. 3, the socket shell 10 is formed by a press-molding and has a body portion surrounding an outer peripheral surface of the socket insulator 30 except a front side at which the mating connector is fitted and a rear side opposite to the front side. Specifically, the body portion has an upper portion 11, a bottom portion 12, and opposite side portions 13 and is formed into a rectangular frame defining a space 14 accommodating the socket insulator 30. The body portion is provided with a plurality of first folded portions 18 formed on the rear side and extending downward from a rear edge of the upper portion 11 towards the inside of the fitting portion 1, as shown in FIG. 2.

Figure 4:
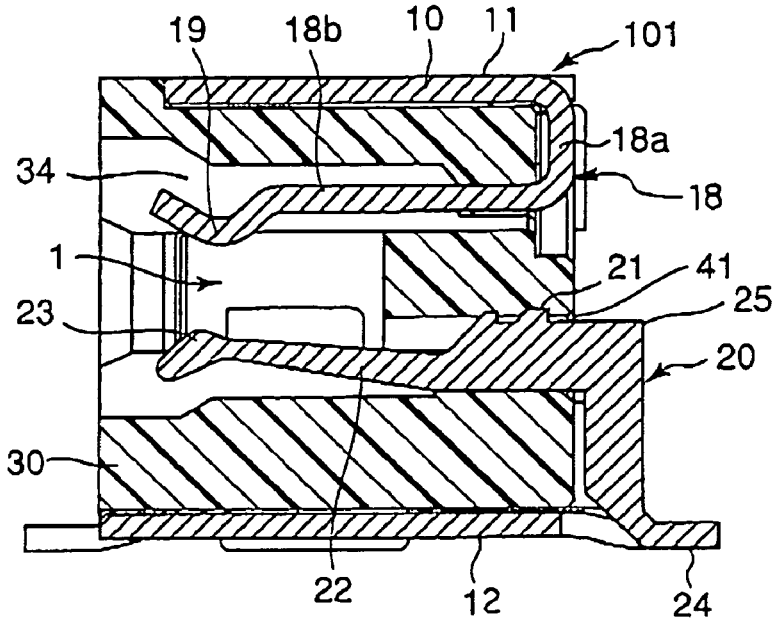
FIG. 4 is a sectional view mainly showing a contacting portion of the socket connector in FIG. 1.

As best shown in FIG. 4, each of the first folded portions 18 is formed by extending the upper portion 11 of the socket shell 10 and has a press-fit portion 18*a* to be press-fitted to the insulator 30, a spring portion 18*b* faced to one of the contacts 20 in a vertical direction, and a contact point portion 19 formed frontward of the spring portion 18*b* and curved to protrude downward. Each of the first folded portions 18 forms a ground contact terminal to be contacted with a ground terminal or a shell of the mating connector.

The ground contact terminal can be formed without making a hole or a slit in the socket shell 10. Therefore, the number of parts can be reduced without degrading the mechanical strength of the socket shell 10 and the electrical performance thereof. Furthermore, the upper portion 11 and the first folded portions 18 are cooperated with each other to clamp the upper portion 30*a* of the socket insulator 30. Thus, the socket shell 10 is tightly and elastically coupled to the insulator 30. With this structure, the connector is prevented from being unnecessarily increased in size.

The socket shell 10 has a pair of second folded portions 16 of a rectangular shape formed inside the opposite side portions 13, respectively. Each of the second folded portions 16 is press-fitted into the guide groove 37 of the socket insulator 30 and serves as a pressing portion to be frictionally engaged with the socket insulator 30. The second folded portion 16 is provided with a lock portion 17 having a rectangular hole.

The socket shell 10 further has a pair of soldering portions 15*a* formed on opposite sides and protruding from the bottom portion 12 outward in the longitudinal direction, a pair of soldering portions 15*b* formed on the rear side and protruding rearward from the bottom portion 12, and a plurality of soldering portions 15*c* formed on the front side and protruding frontward from the bottom portion 12. Further, a pair of press-fit protrusions 39 extend frontward from the bottom portion 12 to be press-fitted into the press-fit holes 36 and fixed to the socket insulator 30. The soldering portions 15*c* extend frontward of the press-fit portions 39 and below the press-fit portions 39. The soldering portions 15*c* are received in a plurality of grooves 42 formed on a bottom surface of the socket insulator 30.

As best shown in FIG. 4, each of the socket contact 20 has a generally L shape and has a holding portion 25 held by the socket insulator 30, a contacting portion 23 to be contacted with a signal contact of the mating connector, a spring portion 22 between the holding portion 25 and the contacting portion 23, and a terminal portion 24 formed at a lower end of the holding portion 25, bent to be parallel to the board (not shown), and adapted to be soldered to the board. The holding portion 25 has a press-fit portion 23 to be press-fitted into a receiving hole 41 of the socket insulator 30.

As shown in FIG. 3, the socket shell 10 is coupled to the socket insulator 30 from the rear side opposite to the fitting portion 1 As a consequence, the socket shell 10 is fixed to the socket insulator 30. Therefore, it is possible to provide the electrical connector without a boundary between different components on the surface of the fitting portion 1.

The socket connector 101 is assembled in the following manner.

In FIG. 3, the socket shell 10 is coupled with the socket insulator 30 from the rear side. Then, the press-fit protrusions 39 are press-fitted to the press-fit holes 36, respectively. The second folded portions 16 are inserted into the guide holes 37 of the socket insulator 30, respectively. The press-fit portions 18*a* of the first folded portions 18 are press-fitted into the ground grooves 34, respectively.

Thereafter, the press-fit portions 21 of the socket contacts 20 are press-fitted into the contact grooves 35 from the rear side of the socket insulator 30, respectively. Then, the contact point portions 19 and the contacting portions 23 are placed in the fitting portion 1 to face each other in the vertical direction. It is noted here that the number of the contact point portions 19 is smaller than the number of the contacting portions 23.

The socket connector 101 assembled as mentioned above is fixed to the board by soldering the soldering portions 15*a*, 15*b*, and 15*c*. In the socket connector 101 having the above-mentioned structure, the boundary between the components on the front surface of the fitting portion 1 is minimized. Further, the socket connector can be readily designed to have a size such that the guide posts 68 of the plug connector 102 cannot enter the connecting hole of the fitting portion 1. Even if blind mating is carried out, the socket connector is hardly damaged.

Figure 5:
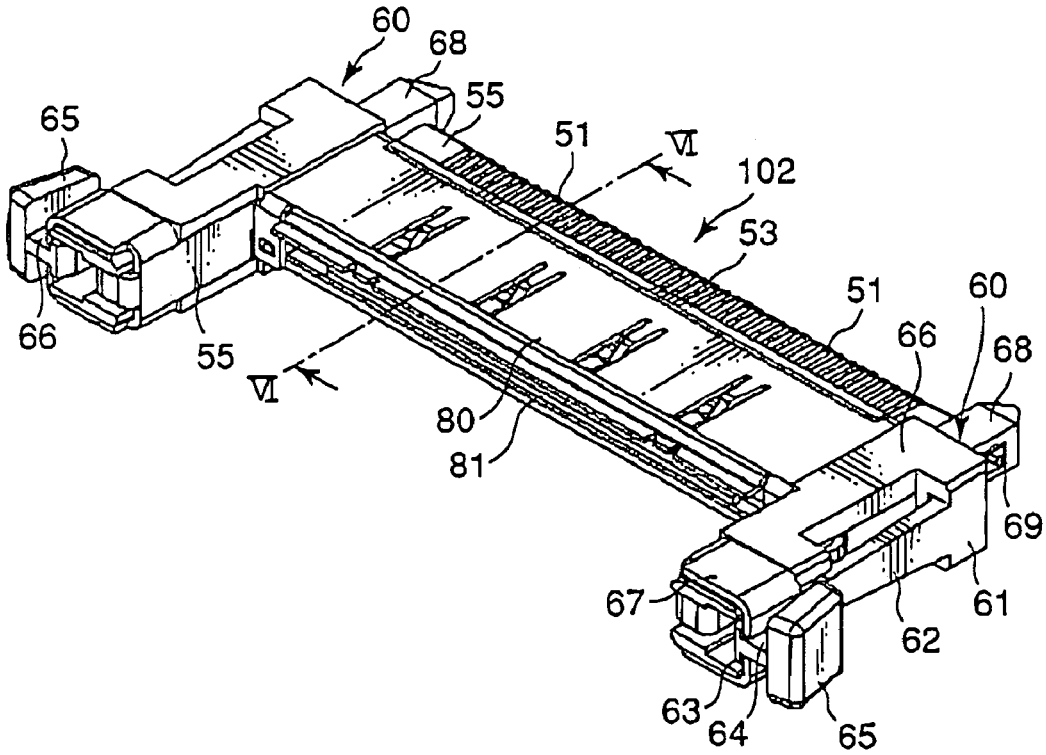
FIG. 5 is a perspective view of a plug connector to be mated with the socket connector in FIG. 1.
Figure 6:
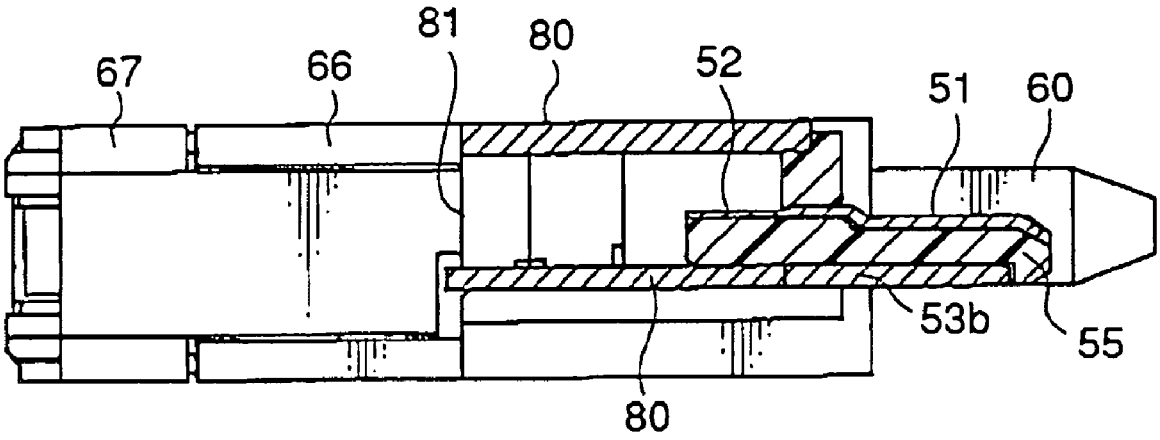
FIG. 6 is a sectional view taken along a line VI—VI in FIG. 5.

Referring to FIGS. 5 and 6, description will be made of the mating connector to be fitted to the connector in FIG. 1.

The mating connector may herein be called a mating member and, specifically, is a plug connector 102. The plug connector 102 comprises a plate-like plug insulator 55, a plurality of plug contacting portions (contacts) 51 formed at a front side of the plug insulator 55 on an upper surface thereof to extend in a back-and-forth direction and arranged in parallel to one another in a predetermined direction, a pair of plug shells 80 covering upper and lower sides of the plug insulator 55, respectively, and a pair of lock portions 60 formed on opposite sides of the plug insulator 55 to be integral with the plug insulator 55. A flat cable or a flexible print board is inserted through an opening 81 between rear ends of the plug shells 80 and is connected to terminal portions 52 of the plug contacts 51 by soldering or the like.

Each of the rectangular-cylindrical guide posts 68 has slant surfaces formed at its front end. Each of the lock portions 60 further has a supporting portion 61, a lever 62, and an operating portion 65 having a rectangular plate-like shape and formed on a rear side to open outward. Each of the guide posts 68 is provided with a locking claw 69 formed on its outer surface and urged by an elastic member (not shown) to protrude outward. When the operating portions 65 are pressed inward in the widthwise direction, the locking claws 69 are retreated inward. The reference numerals 64 and 63 represent a stopper and a guide member for inhibiting outward movement of the lock lever and guiding inward movement.

In the state where the plug connector 102 is turned upside down as shown in FIG. 5, the guide posts 68 are inserted into and fitted to the guide holes 33 formed on opposite sides of the socket connector 101 shown in FIG. 1 and opened frontward, respectively. Then, the locking claws 69 are engaged with the lock holes 17. Thus, a locked state is established. Simultaneously, the plug contacts 51 and the socket contacts 20 are contacted and connected to each other. In this state, the first folded portions 18 serve as ground contacts which are cooperated with the socket contacts 23 to pinch the plug connector 102.

In order to release the socket connector 101 and the plug connector 102 from each other, the operating portions 65 are pushed inward. Then, the locking claws 69 are allowed to freely enter the inside and the locked state is canceled. Accordingly, the plug connector 102 can be removed from the socket connector 101.

In the plug connector 102 mentioned above, the guide posts 68 are formed wider than the connecting hole of the fitting portion 1 of the socket connector 101 in the vertical direction so as not to enter into the connection hole of the fitting portion 1 of the socket connector 101. Therefore, the mechanical strength is high and the electrical performance is excellent.

While the present invention has thus far been described in connection with the preferred embodiment thereof, it will readily be possible for those skilled in the art to put this invention into practice in various other manners. In the foregoing, the connector has a number of contacts. Alternatively, the connector may be implemented with only one contact. Similarly, the connector has a plurality of the first folded portions in the foregoing but may be implemented with only one first folded portion. The first folded portion has the press-fit portion. However, the press-fit portion may be replaced by other appropriate means.

What is claimed is:

1. An electrical connector comprising:

an insulator having a fitting portion for receiving a mating member;

a contact coupled to the insulator and adapted to be electrically connected to the mating member, the contact including a holding portion held by the insulator and a spring portion extending from the holding portion into the fitting portion in a predetermined direction; and a shell of a conductive material coupled to the insulator, the shell including:

a body portion surrounding an outer peripheral surface of the insulator; and a first folded portion extending from the body portion and folded inward of the body portion, the first folded portion including:

a contact point portion to be contacted with the mating member in the fitting portion; and a spring portion extending in the predetermined direction and coupled to the contact point portion to make the contact point portion elastically movable.

2. The electrical connector according to claim 1, wherein the insulator has an escape groove formed at a position corresponding to the contact point portion and the spring portion and opened towards the fitting portion.

3. The electrical connector according to claim 1, wherein the insulator has a press-fit groove, the first folded portion further having a press-fit portion press-fitted into the press-fit groove between the body portion and the spring portion.

4. The electrical connector according to claim 1, wherein the contact point portion faces the contact.

5. The electrical connector according to claim 1, wherein the contact has a contacting portion to be contacted with one surface of the mating member, the contact point portion being contacted with the other surface of the mating member opposite to the one surface.

6. The electrical connector according to claim 1, wherein the shell further has a second folded portion extending from the body portion and folded inward of the body portion, the second folded portion having a pressing portion to be frictionally engaged with the insulator.

7. The electrical connector according to claim 6, wherein the second folded portion further has a lock portion to be engaged with the mating member to inhibit the mating member from being released from the fitting portion.

8. The electrical connector according to claim 1, wherein the shell further has a soldering portion placed on a predetermined surface, the contact having a terminal portion located on the predetermined surface.

9. The electrical connector according to claim 1, wherein the shell has an upper portion and a lower portion facing each other via the insulator, the soldering portion being positioned on the lower portion, the first folded portion extending from the upper portion.

10. The electrical connector according to claim 9, wherein the insulator has a front surface at which the mating member is received in the fitting portion and a rear surface opposite to the front surface, the first folded portion extending from a rear end of the body portion.

11. The electrical connector according to claim 1, wherein the first folded portion serves as a ground contact which cooperates with the first-mentioned contact to pinch the mating member.

* * * * *